US005829366A

United States Patent [19]

Uono

[11] Patent Number: 5,829,366

[45] Date of Patent: Nov. 3, 1998

[54] ANTI-EARTHQUAKE HOLDING ROD AND ANTI-EARTHQUAKE FURNITURE HAVING THE SAME

[76] Inventor: Toshiaki Uono, 27-2 Mejiro 4-chome, Toshima-ku, Tokyo, Japan

[21] Appl. No.: 751,553

[22] Filed: Nov. 18, 1996

[30] Foreign Application Priority Data

| | | | |
|---|---|---|---|
| Nov. 21, 1995 | [JP] | Japan | 7-303191 |
| Nov. 21, 1995 | [JP] | Japan | 7-303192 |
| Feb. 22, 1996 | [JP] | Japan | 7-035299 |
| Feb. 22, 1996 | [JP] | Japan | 8-035300 |
| Aug. 7, 1996 | [JP] | Japan | 8-178376 |

[51] Int. Cl.[6] ..... A47B 13/00

[52] U.S. Cl. ..... 108/161; 108/28; 108/150

[58] Field of Search ..... 108/150, 180, 108/186, 187, 191, 58.1, 161; 248/638, 636, 562, 903; 52/167.1, 167.4, 167.9

[56] References Cited

U.S. PATENT DOCUMENTS

| | | | |
|---|---|---|---|
| 615,130 | 11/1898 | Beckman | 108/28 |
| 1,824,682 | 9/1931 | O'Neil | 108/191 |
| 3,139,189 | 6/1964 | Kolarik | 108/28 X |
| 3,391,660 | 7/1968 | Stewart | 108/150 X |
| 4,805,542 | 2/1989 | Peterson et al. | 108/150 |
| 5,379,975 | 1/1995 | Berkowitz et al. | 108/150 X |
| 5,499,585 | 3/1996 | Vanderminden, Sr. | 108/150 X |

FOREIGN PATENT DOCUMENTS

| | | | |
|---|---|---|---|
| 2698250 | 5/1994 | France | 108/150 |

*Primary Examiner*—Jose V. Chen
*Attorney, Agent, or Firm*—Notaro & Michalos P.C.

[57] ABSTRACT

In order to provide an anti-earthquake holding rod or anti-earthquake furniture such as a table and desk having the anti-earthquake holding rod fixed thereto capable of preventing a person escaped under a table or desk during an earthquake from being thrown out of its location and further capable of increasing the strength of the table or desk, the anti-earthquake holding rod is constructed by a support, a plurality of fixing members constructed to be fixed to a lower part of a top plate of a table or desk arranged at the upper part of the support in the radial direction, and an adjusting supporting member fixed movably in the axial direction to the lower part of the support. It is satisfactory to fix the fixing members to the lower surface of the top plate of the desk or the table through a fixing disk or threadedly engage the adjusting supporting member with the lower part of the support as to move axially. The anti-earthquake furniture such as a table and desk is constructed by fixing the anti-earthquake holding rod to the lower part of the top plate. In this case, the holding rod may be suspended down with its extremity end being not contacted with the ground.

9 Claims, 19 Drawing Sheets

ANTI-EARTHQUAKE HOLDING ROD AND ANTI-EARTHQUAKE FURNITURE HAVING THE SAME

BACKGROUND OF THE INVENTION

1. Field of the Invention

This invention relates to an anti-earthquake holding rod and anti-earthquake furniture having this anti-earthquake holding rod therein which can exhibit their own anti-earthquake effectiveness in the case that an earthquake of the intensity of four or more on Japanese scale occurs as items stored in a room may drop or pieces of furniture in a room may fall, in particular.

2. Description of the Related Art

In the case that an occupant in a room experiences an earthquake there, at first the occupant must escape by himself or by herself under a table or desk nearby to see the situation for a while. This has been explained as a safety countermeasure to keep the safe condition of a physical body and the life safety of an occupant when the occupant experiences an earthquake and also in the case of an earthquake drill, this has been actually practiced for escaping in an earthquake.

However, in the case that an occupant actually experiences an earthquake of such an intensity in which the occupant must escape under a table or desk nearby, there may occur some troubles that the table or desk under which the occupant escapes sometimes falls down on a floor or moves by itself on the floor and the physical body of the occupant escaped under the table or desk is also thrown away therefrom.

In the case of a table or desk having four legs, for example, which was not provided with a support at its central location, there was a problem that its top plate was broken to apply a direct striking against the occupant escaped under the table or desk when another piece of furniture or a beam of a ceiling falls down in response to the vibration of an earthquake.

OBJECT OP THE INVENTION

In view of the foregoing, it is an object of the present invention to provide an anti-earthquake holding rod and anti-earthquake furniture such as a table and desk having the anti-earthquake holding rod fixed thereto, which can prevent a person escaped under the table or desk during occurrence of an earthquake from being thrown away therefrom and also increase the strength of the table or desk.

DESCRIPTION OF THE PREFERRED EMBODIMENTS

Figure 1:
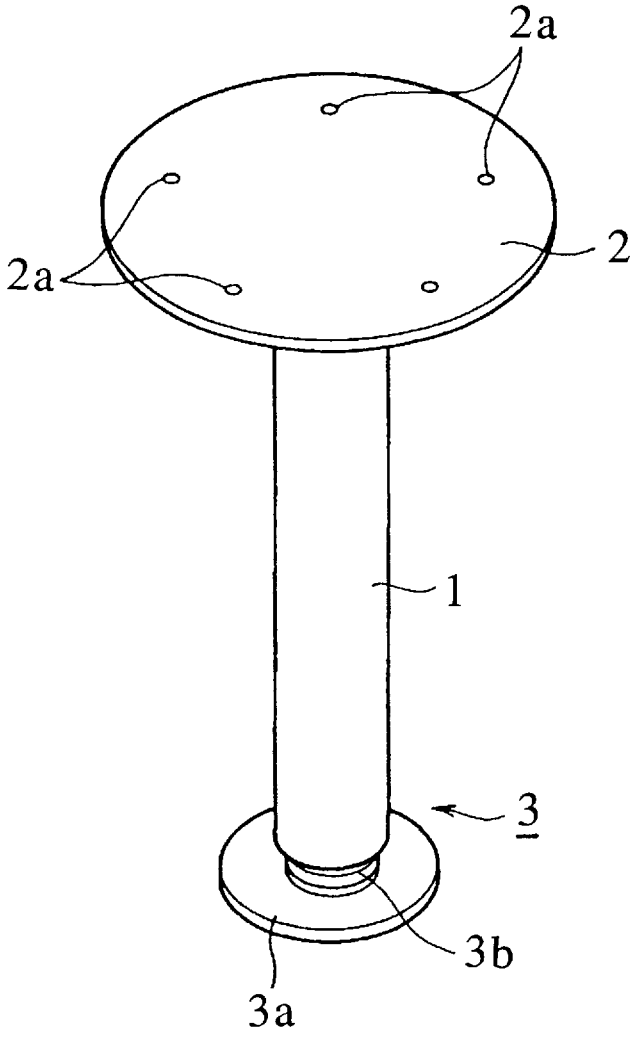
FIG. 1 is a perspective view showing one embodiment of an anti-earthquake holding rod of the present invention.
Figure 2:
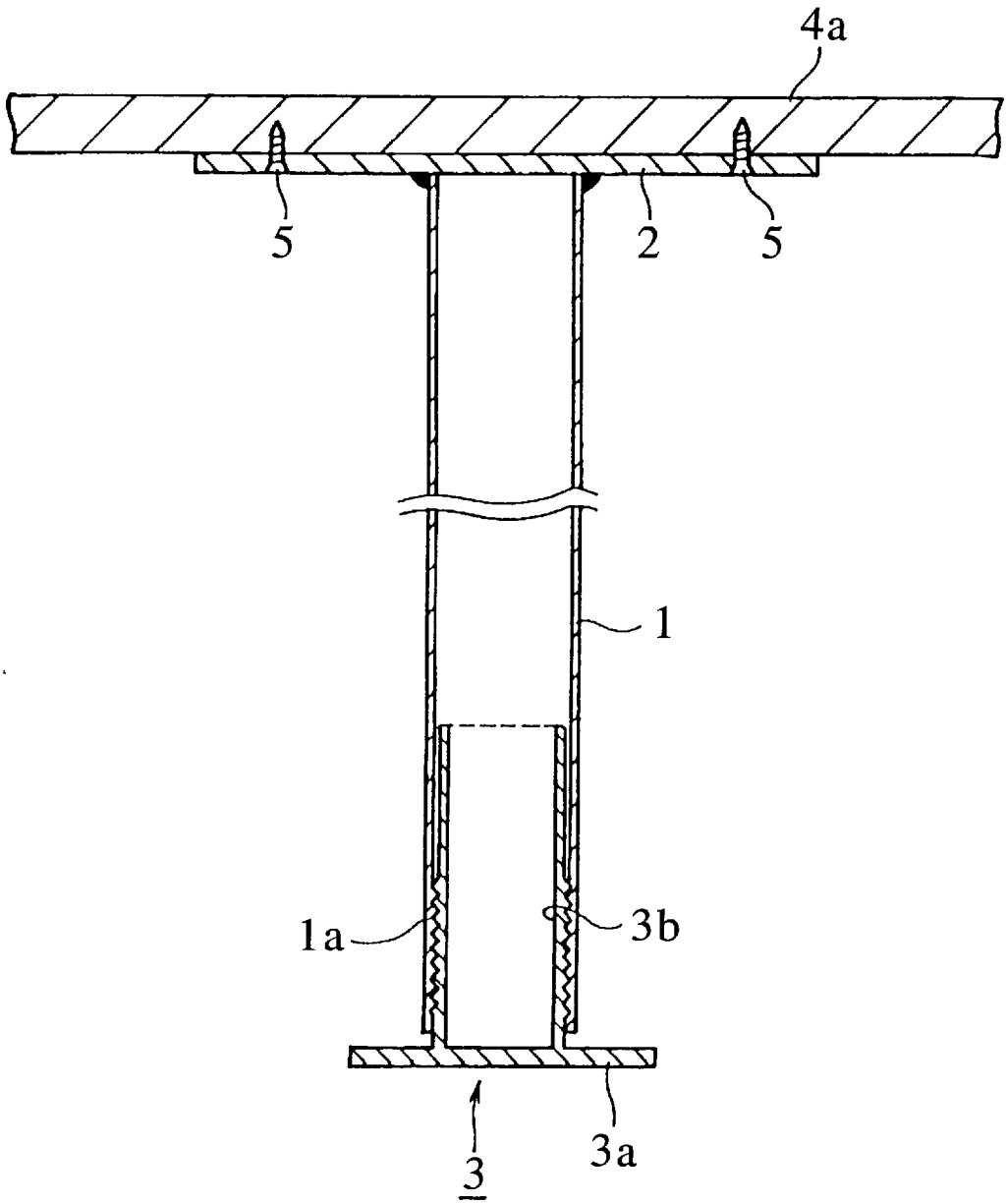
FIG. 2 is a longitudinal sectional view showing a state in which the anti-earthquake holding rod shown in FIG. 1 is fixed to the lower part of a top plate of a table or desk.
Figure 3:
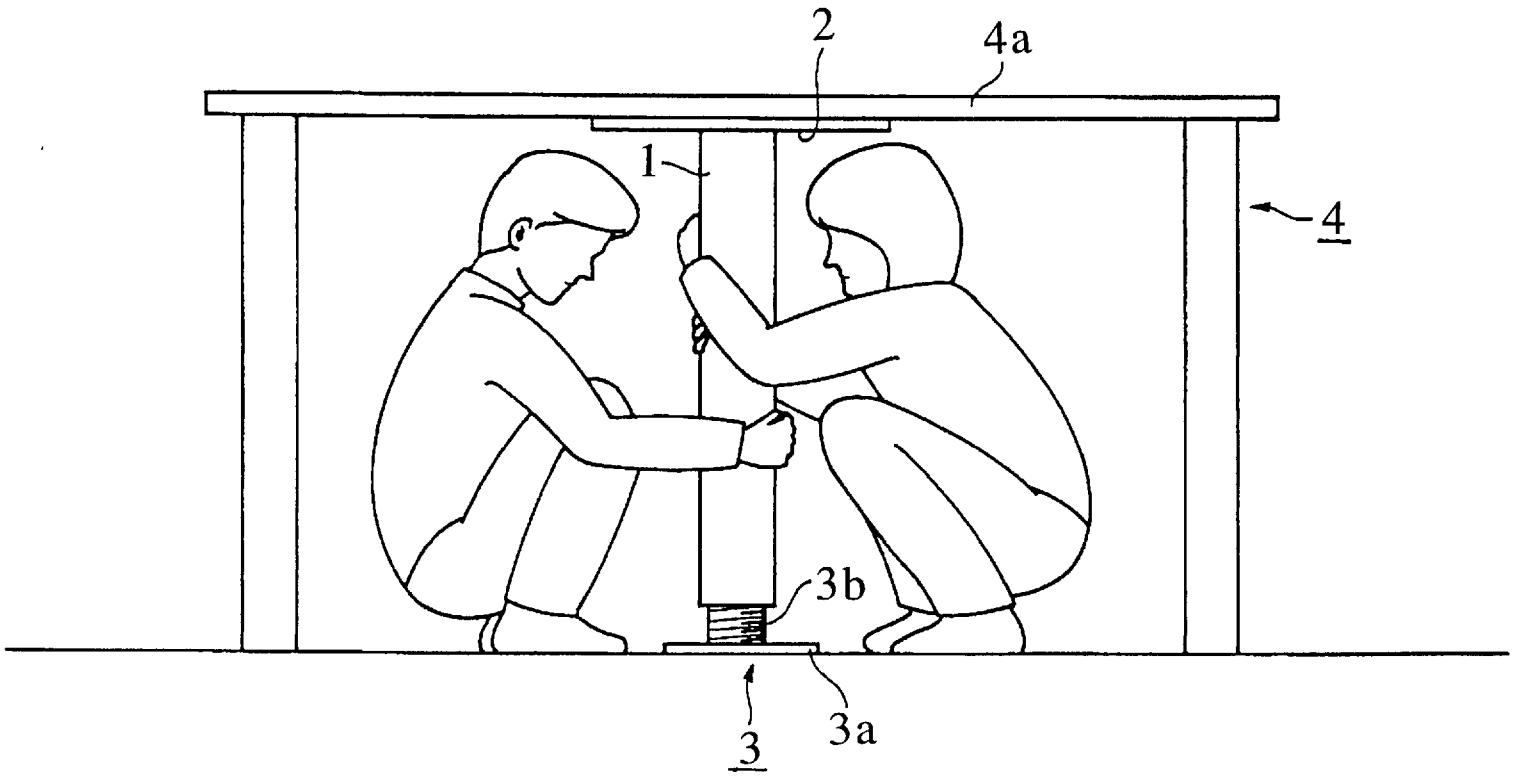
FIG. 3 is a front elevational view of the anti-earthquake holding rod shown in FIG. 1 and the table or desk having this anti-earthquake holding rod fixed thereto shown in FIG. 2.

Some preferred embodiments of the present invention will be described in detail with reference to the drawings. In FIGS. 1 to 3, reference numeral 1 denotes a pipe-shape support made of material having a high strength such as metal of steel, stainless steel and aluminum, and a synthetic resin, it is apparent that the shape is not necessarily a pipe-shape, and its section in its top plan can be of several shapes such as round, ellipse, square and other polygonal shapes, and then the shape is not limited to that shown in the preferred embodiment. A flange-shape fixing member 2 having a plurality of fixing holes 2*a* is arranged at the upper part of the support 1 by some methods such as fixing, adhering and integral molding. Although the fixing member 2 is circular in the preferred embodiment, various kinds of shapes such as ellipse, triangle, rectangle and other polygonal shapes can be applied and so it is not limited to that shown in the preferred embodiment.

To the lower part of the support 1 is fixed an adjusting supporting member 3 comprised of a flange part central part of the flange part 3*a*, with the threaded rod 3*b* being threadedly engaged with a female threaded part 1*a* arranged in the support 1 in such a manner that its height can be adjusted in the vertical direction.

Accordingly, as shown in FIG. 2, the fixing member 2 is fixed to the lower surface of a top plate 4*a* of a table or desk with fixing screws 5 or bolts, the support 1 is suspended down from the top plate 4*a*, and then the adjusting supporting member 3 is rotated in any of the clockwise or counterclockwise direction so as to adjust its height and contacted to the ground, resulting in that its fixing to the existing table or desk is completed. As shown in FIG. 3, in the case that an earthquake occurs, persons escape under the table and hold the support 1, eliminating any possibility that they are thrown out of the table. Also in the case that another piece of furniture, a ceiling or a beam falls on the table, it is possible to prevent the top plate from being broken as much as possible due to the fact that the support is present at the central part of the top plate where it is weak against a pushing pressure. As to the location where the support 1 is fixed, the central part of the top plate becomes the most desirable place in view of the facts that even if a relative position between the table or desk and the persons escaped thereunder is displaced due to the vibration of an earthquake, the top plate can cover the persons and additionally the central part is the most weak-strength location. It is optional, however, that the location is slightly displaced from the central part. In addition, in the case that the table or desk is large in size, the supports can be fixed to several locations.

Figure 4:
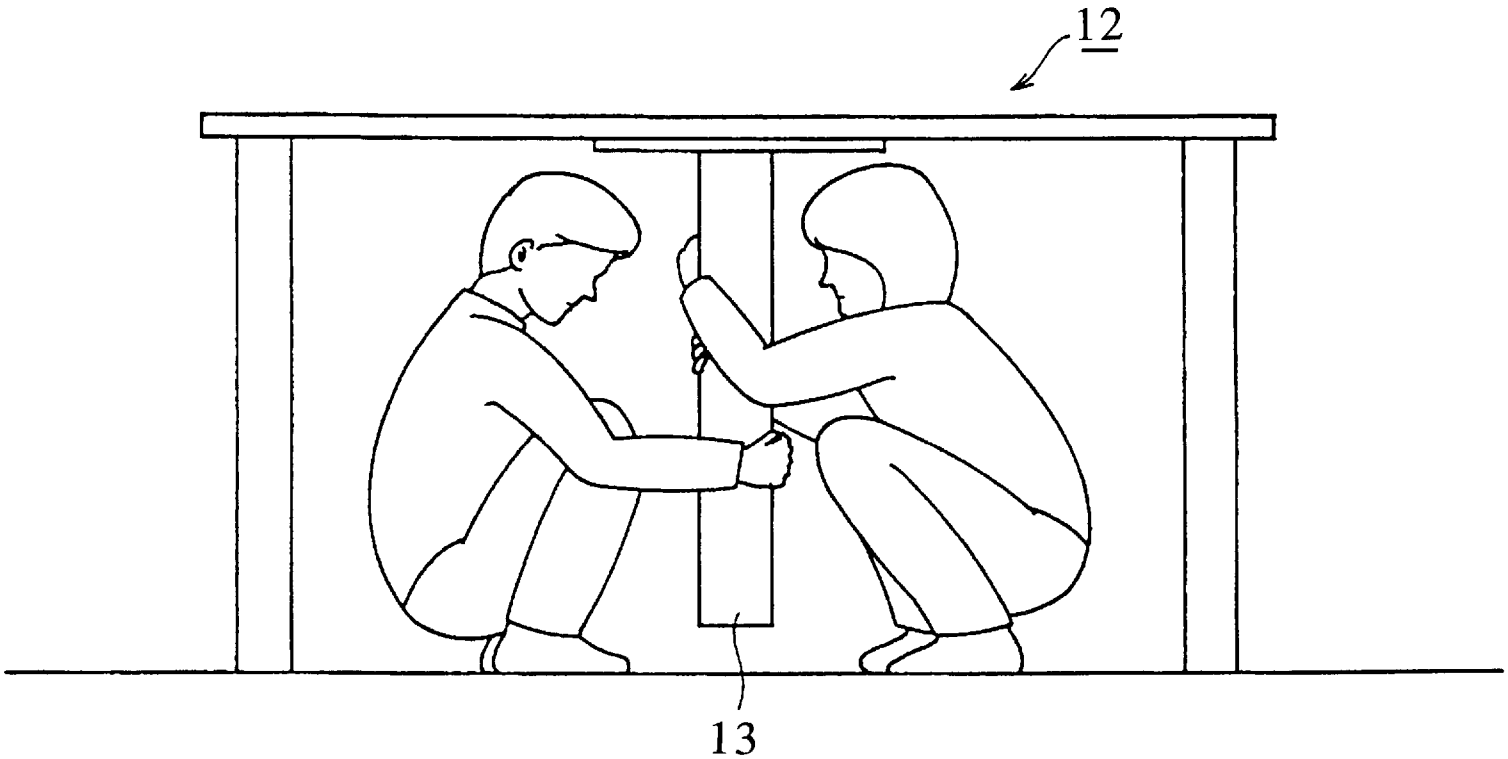
FIG. 4 is front elevational view of a table or desk showing another preferred embodiment of the anti-earthquake holding rod of the present invention.

FIG. 4 shows a still another preferred embodiment, in which an adjusting supporting member is not fixed to the extremity end (lower end) of a support 11 fixed to the lower part of a top plate of a piece of furniture 10 such as a table and desk, resulting in that the lower end of the support 11 is not contacted with a floor, but is floated over the floor.

Even if the support is worked as described above, it can accomplish one object of the present invention that persons escaped under the table or desk 10 hold the support and are accordingly not thrown out of the furniture.

Figure 5:
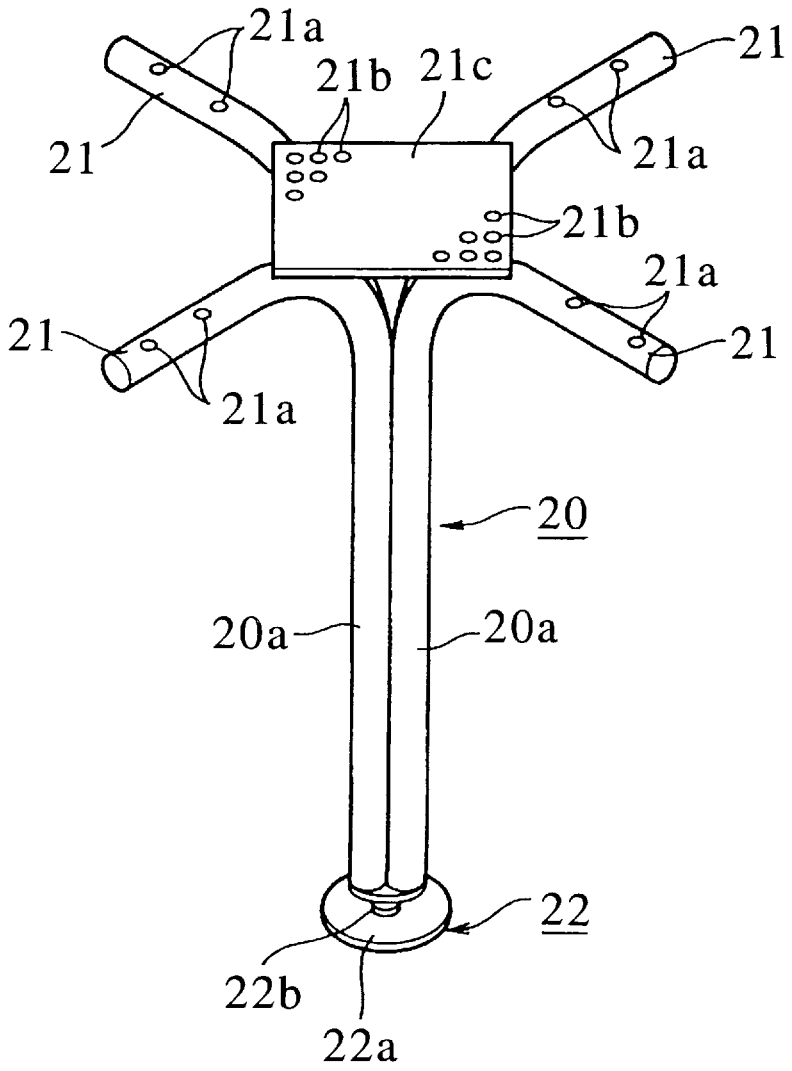
FIG. 5 is a perspective view showing another preferred embodiment of the anti-earthquake holding rod of the present invention.
Figure 6:
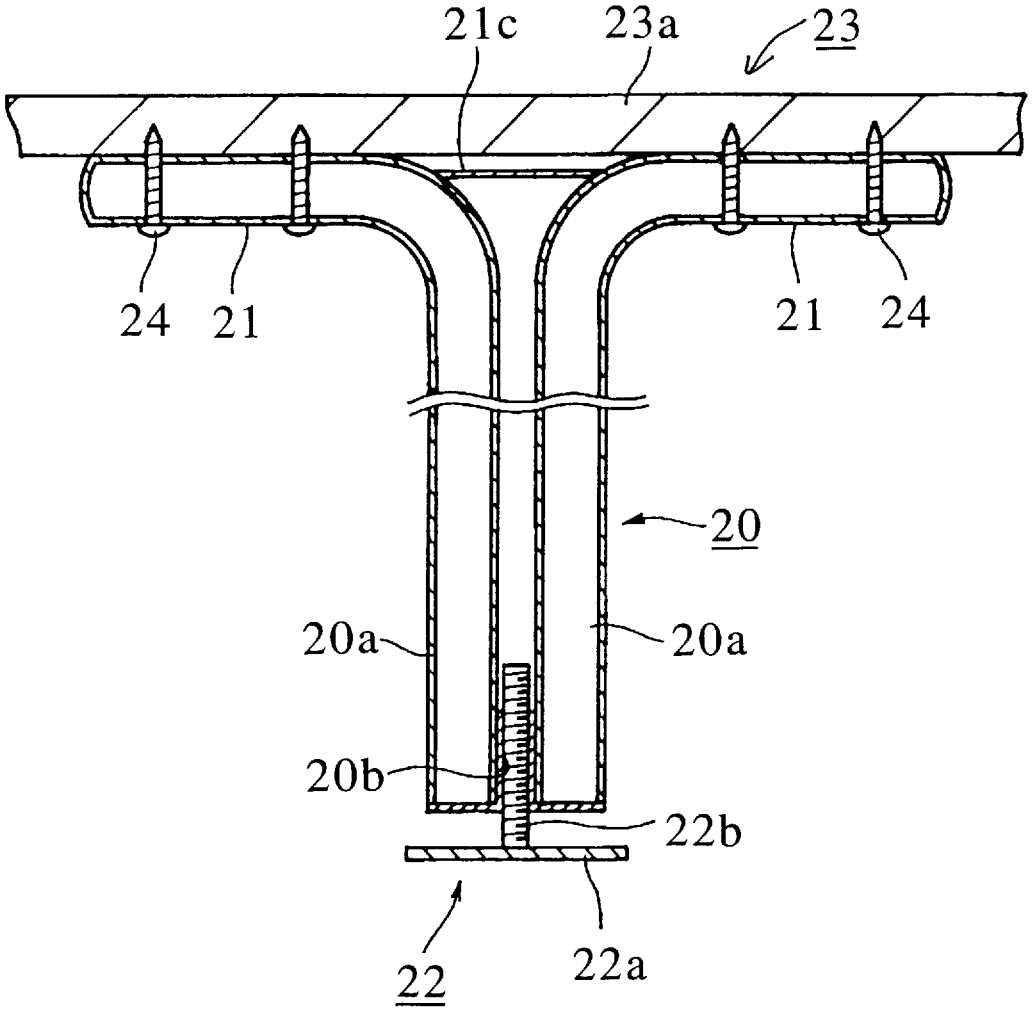
FIG. 6 is a longitudinal sectional view showing a state in which the anti-earthquake holding rod shown in FIG. 5 is fixed to the lower part of a top plate of a table or desk.
Figure 7:
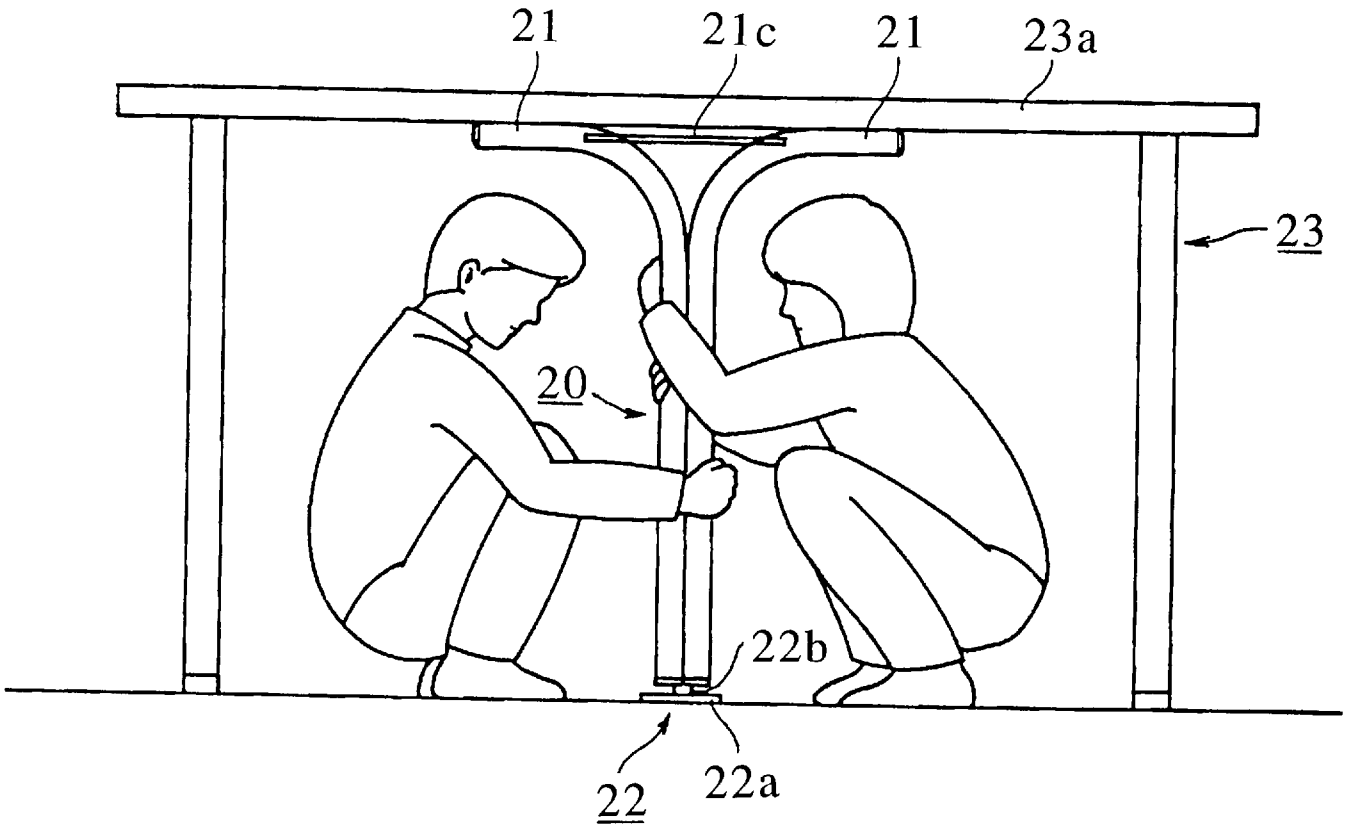
FIG. 7 is a front elevational view of the anti-earthquake holding rod shown in FIG. 5 and the table or desk having the anti-earthquake holding rod fixed thereto shown in FIG. 6.

FIGS. 5 to 7 illustrate another preferred embodiment of the present invention, wherein in FIGS. 5 to 7, reference numeral 20 denotes a support which is constructed by bundling four small pipes 20*a* made of high strength material such as metallic material of steel, stainless steel and aluminum, and a synthetic resin. It is apparent that the support is not constructed with bundled small pipes, but may be constructed by one rod or one pipe. In addition, its section in its top plan may be of round, ellipse, rectangular and other polygonal shapes and it is not limited to that shown in the preferred embodiment. To the upper part of the support 20 are arranged four. fixing members 21 each having fixing holes 21*a* in the radial extending manner from each of the small pipes 20*a*. Although the fixing member 21 shown in the preferred embodiment is curved, it may be bent from each of the small pipes in a right angle direction and there is no limitation in its bending manner. On the four fixing members 21 is inserted and placed a protection plate 21*c* having many small holes 21*b* and the protection plate 21 is fixed by welding or fixing with screws.

To the lower part of the support 20 is fixed an adjusting supporting member 22 comprised of a flange part 22*a* and a threaded rod 22*b* arranged vertically from the central part of the flange part 22*a* in such a manner that its height can be adjusted in the vertical direction under the arrangement in which the threaded rod 22*b* is threadedly engaged with a female threaded part 20*b* arranged in the support 20.

Accordingly, as shown in FIG. 6, each of the fixing members 21 is fixed to the lower surface of a top plate 23*a* of a piece of furniture 23 such as a table and desk with fixing screws 24 or bolts so as to cause the support 20 to be suspended down from the top plate 23*a*, the adjusting supporting member 22 is rotated in the clockwise or counterclockwise direction to adjust its height and then the support 20 is contacted with the ground, completing its fixing to the existing table or desk. As shown in FIG. 7, in the case that an earthquake occurs, persons escape under the table or desk 23 and hold the support 20, eliminating any possibility that they are thrown out of the table. In addition, in the case that another piece of furniture, a ceiling, a beam and the like falls on the table, it is possible to prevent the top plate 23*a* from being broken as much as possible due to the fact that the support 20 is present at the central part of the top plate which is weak against a pushing force. Although the central part of the top plate is the most preferable location as the place of fixing the support 20 due to the facts that the top plate can cover the persons escaped thereunder even if a relative position between the table or desk and the persons is displaced under the vibration of an earthquake and further the central part shows the most weak strength in the top plate. It is optional, however, to place the support at a slight displaced location. In addition, in the case that the table or desk is large in size, it may be considered to fix the supports at several locations, Further, in the case that the table or desk has a short height, the length of the support is correspondingly made short.

Figure 8:
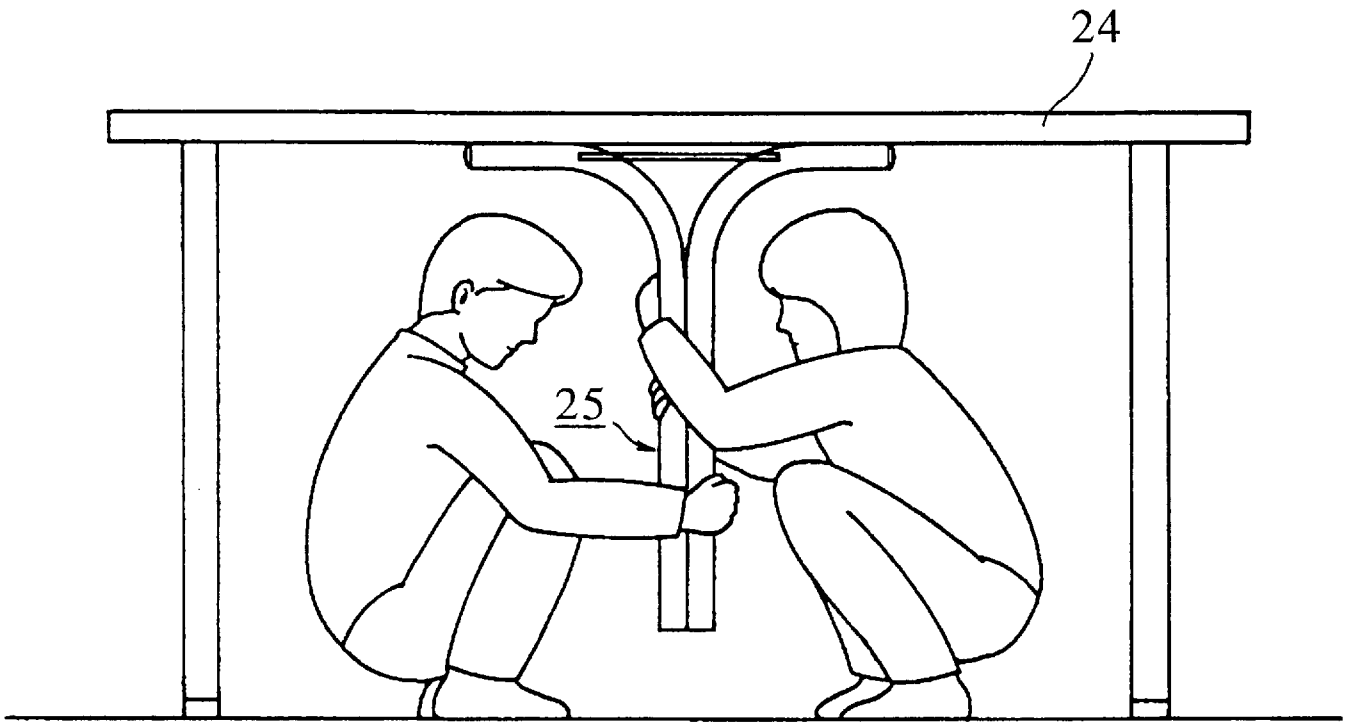
FIG. 8 is a front elevational view of a table or desk showing another preferred embodiment of the anti-earthquake holding rod of the present invention.

FIG. 8 shows a still another preferred embodiment of the present invention, in which an adjusting supporting member is not fixed to the extremity end (lower end) of a support 25 fixed to the lower part of the furniture 23 such as a table and desk, resulting in that the lower end of the support 25 is not contacted with a floor, but floated over the floor.

Even if the support is worked as described above, it can accomplish one object of the present invention that persons escaped under the furniture 23 such as a table and desk hold the support 25 and are accordingly not thrown out of the furniture.

Figure 9:
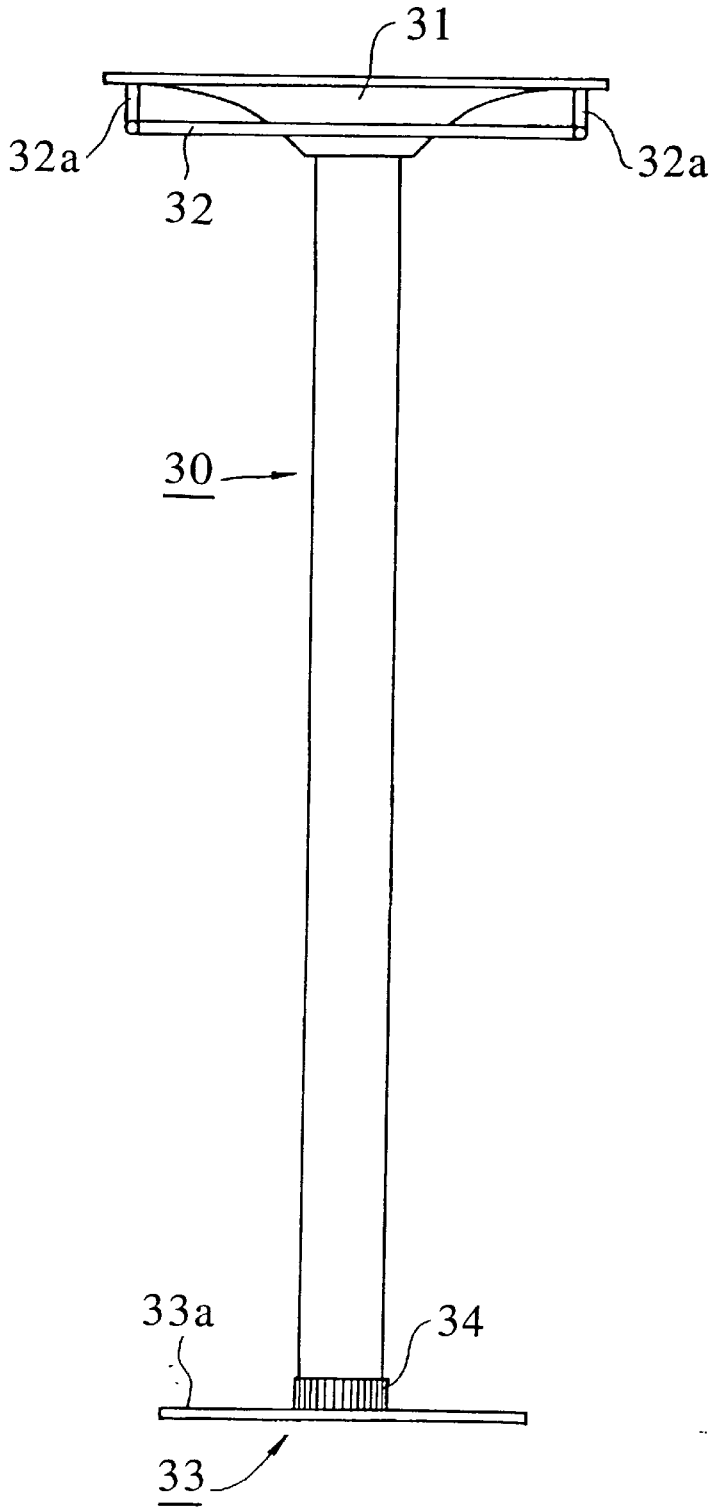
FIG. 9 is a front elevational view for showing a still another preferred embodiment of the anti-earthquake holding rod of the present invention.
Figure 10:
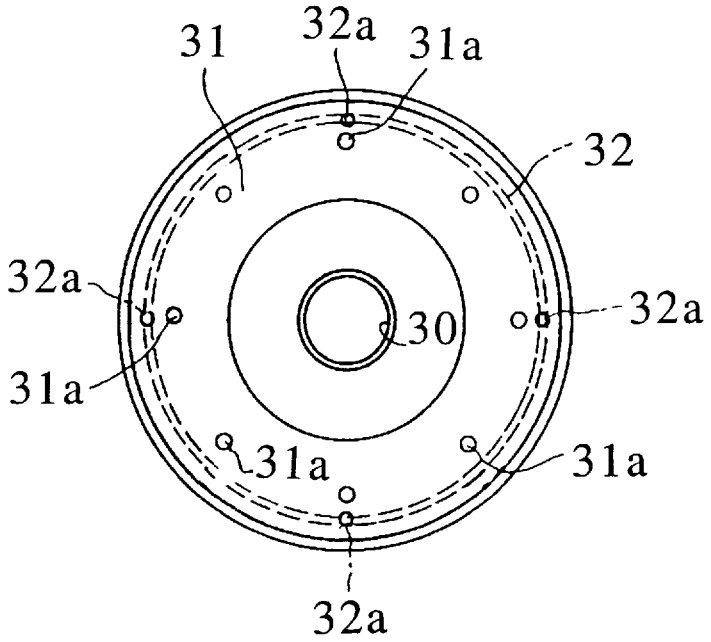
FIG. 10 is a top plan view of the anti-earthquake holding rod shown in FIG. 9.
Figure 11:
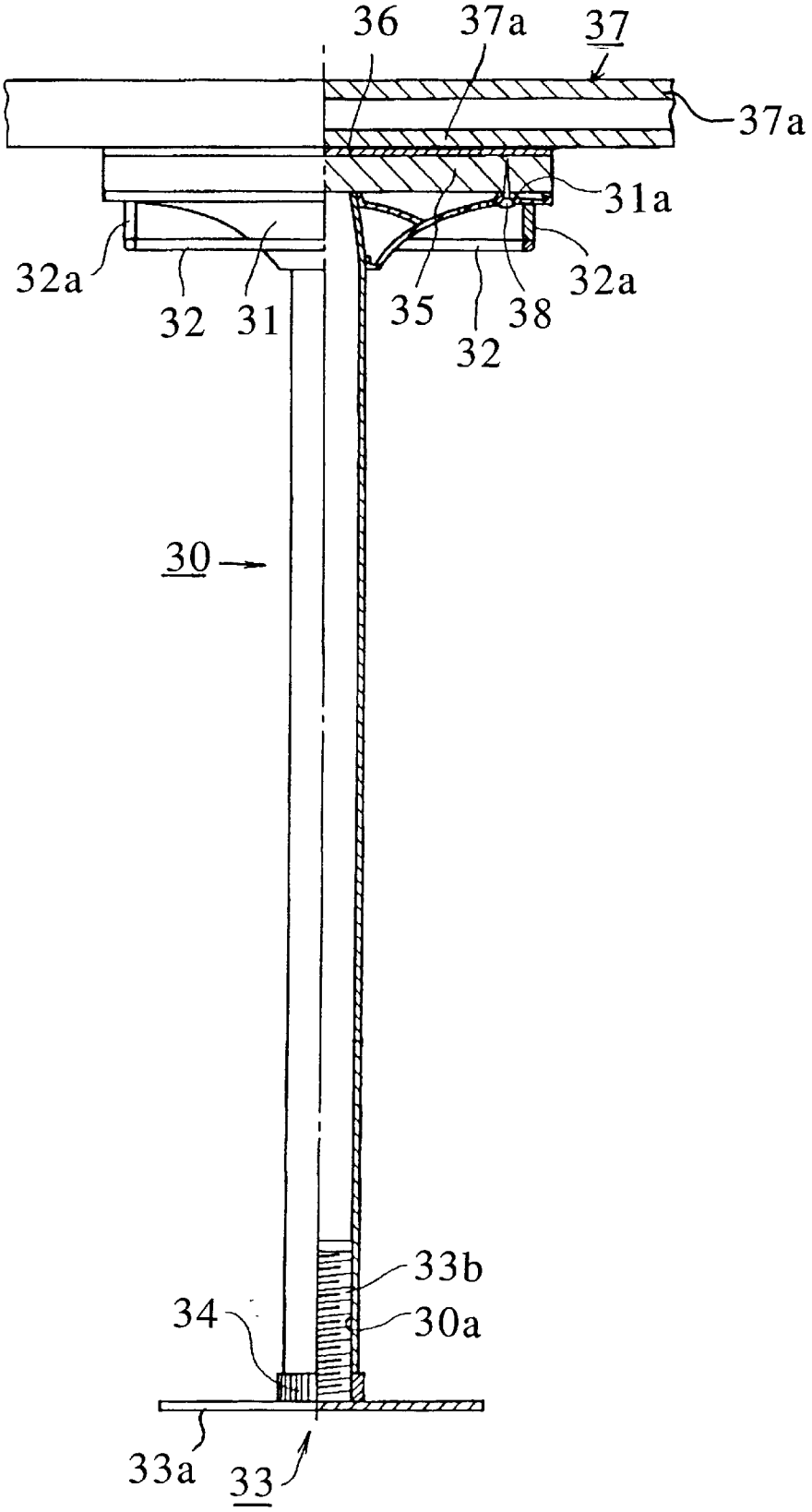
FIG. 11 is a partial sectional view showing a state in which the anti-earthquake holding rod shown in FIG. 9 is fixed to the lower part of a top plate of a table or desk.

FIGS. 9 to 14 illustrate another preferred embodiment of the present invention, wherein in FIGS. 9 to 11, reference numeral 30 denotes a round pipe-shape support made of high strength material such as metallic material of steel, stainless steel and aluminum, and a synthetic resin. It is apparent that the support is not necessarily constructed into the round pipe. In addition, its section in its top plan may be of ellipse, rectangular and other polygonal shapes other than round and it is not limited to that shown in the preferred embodiment. To the upper part of the support 30 is arranged a flange part 31 having a plurality of fixing holes 31*a* by fixing, melt adhering, integral molding and the like. Although the shape of the flange part 31 shown in the preferred embodiment is a substantial funnel shape, it may be formed of various shapes such as ellipse, triangle, rectangle and other polygonal shapes and it is not limited to that shown in the preferred embodiment. To the lower part of the flange part 31 is fixed ring-like hanger means 32 through fixing pins 32*a*, on which some goods to be taken out with such as flashlights, medicines, emergency rations and water (not shown) brought out in the case of emergency are hung. It may also be applicable that the hanger means 32 is fixed to the support 30 with pins, hooks or other means. To the lower part of the support 30 is fixed an adjusting supporting member 33 comprised of a seat part 33*a* and a threaded rod 33*b* vertically arranged from the central part of the seat part 33*a* in such a manner that its height can be adjusted in the vertical direction by threadedly engaging the threaded rod 33*b* to a female threaded part 30*a* arranged in the support 30.

Figure 12:
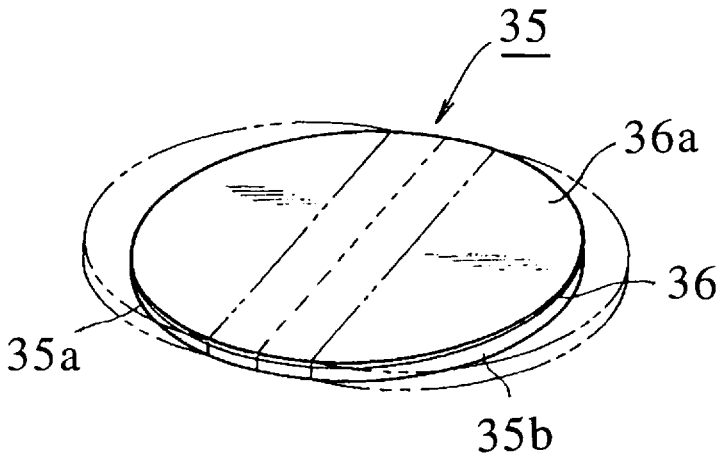
FIG. 12 is a perspective view showing a fixing disk shown in FIG. 11.
Figure 13:
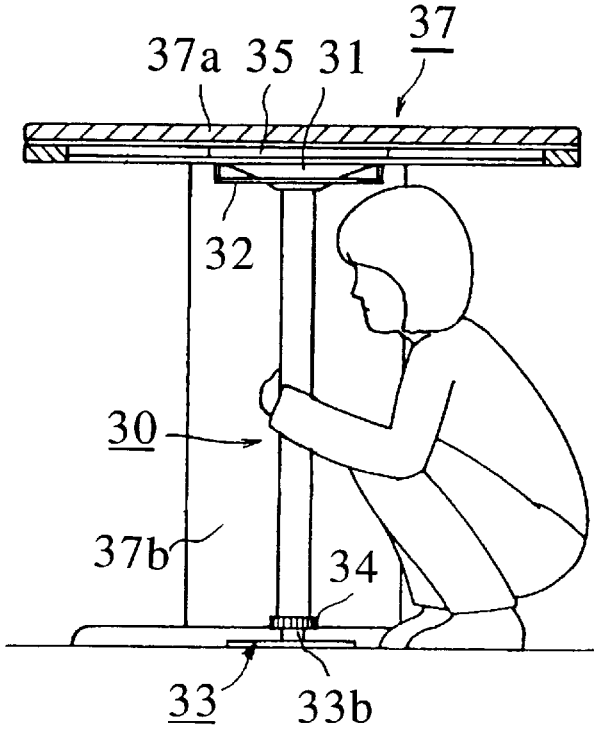
FIG. 13 is an illustrative view showing a state in which a person escapes under the table shown in FIG. 11.

Reference numeral 34 denotes a fixing nut for fixing the adjusting supporting member 33 to the support 30, FIG. 12 shows a fixing disk 35, which is comprised of, for example, two-split semicircular plates 35*a* and 35*b* mainly made of wood, and the plate can be separated by its central part into the semicircular plates 35*a* and 35*b*. As shown in FIG. 13, this fixing disk is used in the case that the flange part 31 is fixed to a top plate 37*a* of a table or desk 37 made of material to which a nail or fixing screw may not be applied. The upper surface of the fixing disk 35 is formed with a strong adhesive agent layer 36 in advance, and a protection sheet 36*a* adhered on the layer 36 is peeled off to enable the entire fixing disk 35 to be adhered to the lower surface of the top plate 37*a*.

Accordingly, at first, the fixing disk 35 is adhered to the lower surface of the top plate 37*a* of the table or desk 37 at its central part, if possible, thereafter, as shown in FIG. 11, the flange part 31 is fixed to the fixing disk 35 by fixing screws 38 or nails (not shown) so as to suspend the support 30 downward from the top plate 37*a*. Then, the adjusting supporting member 33 is rotated in the clockwise or counterclockwise direction so as to adjust the rod height to become the same level as that of a leg 37*b* of the table 37 as shown in FIG. 13 and then contacted with the ground, thereafter it is fastened with the fixing nut 34 and fixed, completing the fixing of the holding rod against the table or desk 37. As shown in FIG. 13, in the case that an earthquake occurs, a person escapes under the table or desk 37 and holds the support 30, eliminating any possibility that the person is thrown out of the table. In addition, in the case that another piece of furniture, a ceiling, a beam and the like fall on the table, it is possible to prevent the top plate 37*a* from being broken as much as possible due to the fact that the support 30 is present at the central part of the top plate 37*a* which is weak against a pressing force. As to the location where the support 30 is fixed, the central part of the top plate 37*a* becomes the most desirable place in view of the facts that even if a relative position between the table or desk 37 and the person escaped thereunder is displaced due to the vibration of an earthquake, the top plate 37*a* can cover the person and additionally the central part is the most weak-strength location in the top plate 37. It is optional, however, that the location is slightly displaced from the central part. In addition, in the case that the table or desk 37 is large in size, it may be applied that the supports can be fixed to several locations.

Figure 14:
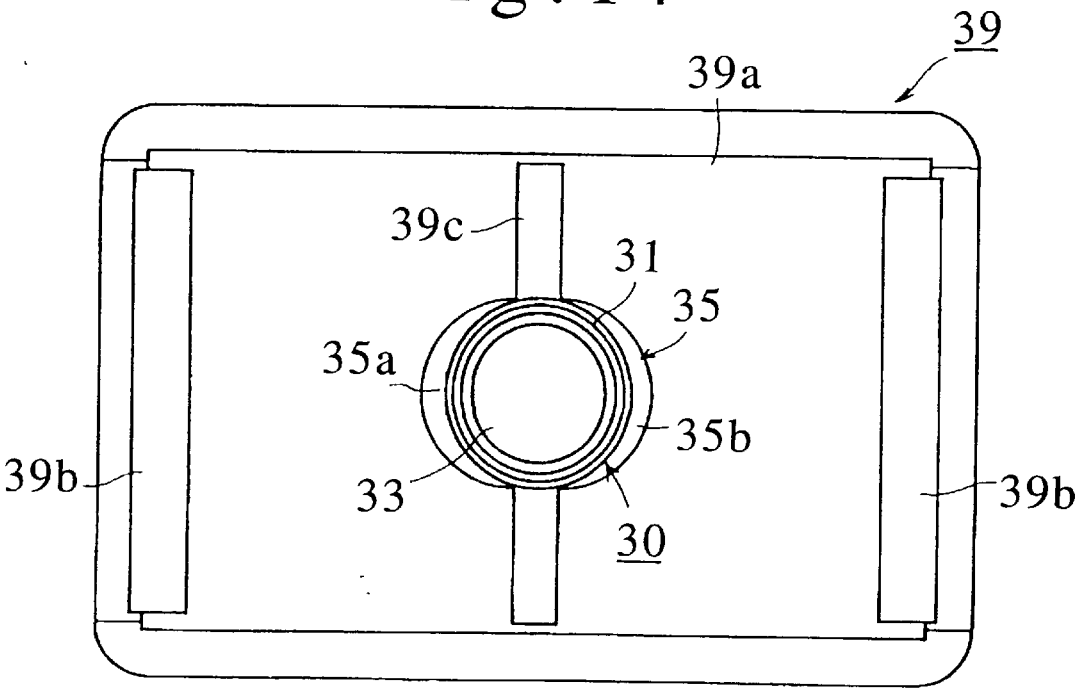
FIG. 14 is a bottom view showing a state in which the anti-earthquake holding rod shown in FIG. 9 is fixed to a table having a reinforcing member fixed at the lower surface of a top plate.

The reason why the fixing disk 35 is divided into the two segments as described above consists in the fact that, in the case that a reinforcing beam member 39*c* as shown in FIG. 14 is fixed to the lower surface of a thin or weak top plate 39*a* of a table or desk 39, the reinforcing beam member 39*c* becomes disturbance when the fixing disk 35 is fixed, so that the fixing disk is divided into the two segments of the half-piece plates 35*a* and 35*b*, the half-piece plates 35*a* and 35*b* are fixed at right and left or front and rear of the reinforcing beam member 39*c* respectively, and then the flange part 31 is fixed to the two-divided fixing disk 35. Further, reference numeral 39*b* denotes a leg.

Figure 15:
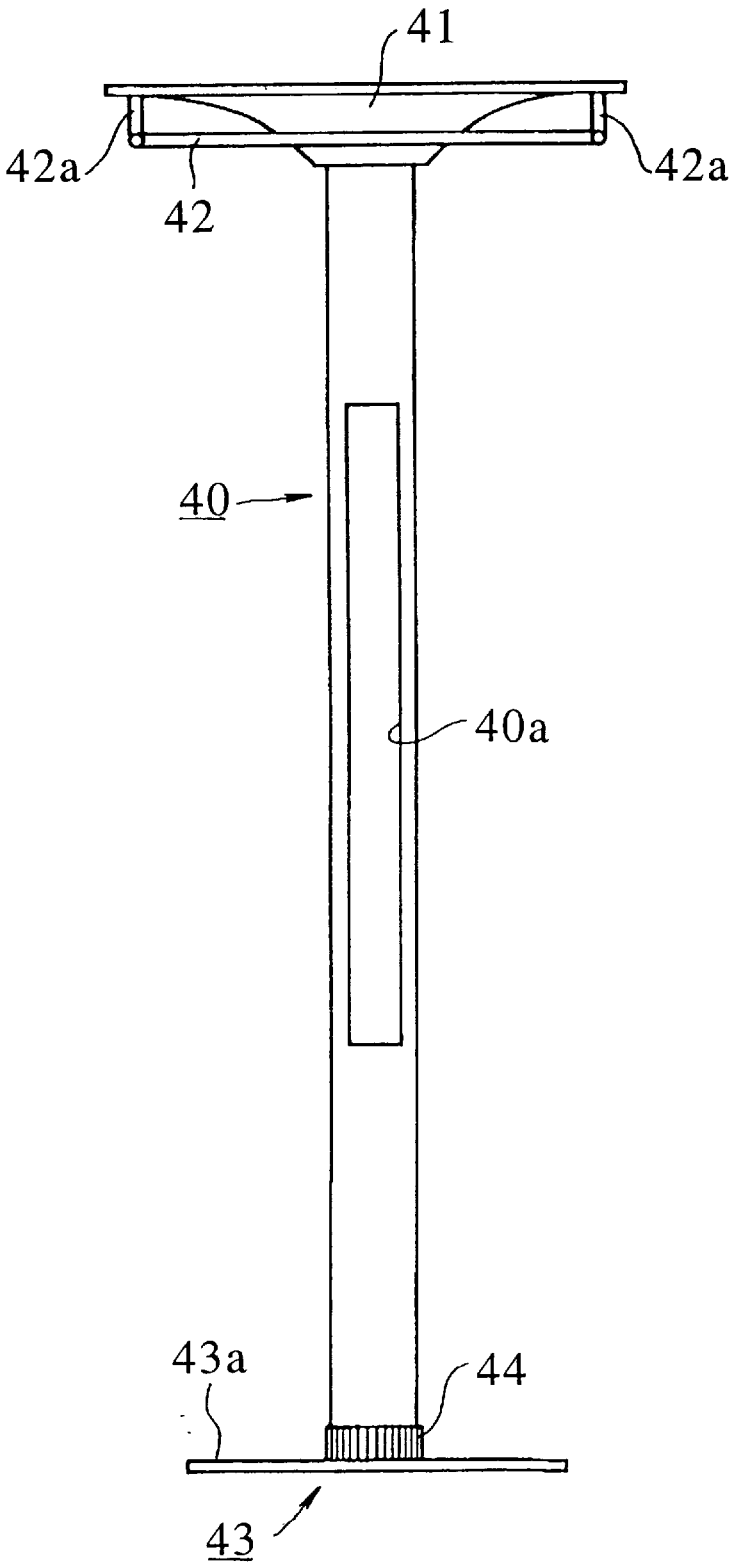
FIG. 15 is a front elevational view showing another preferred embodiment of the anti-earthquake holding rod of the present invention.
Figure 16:
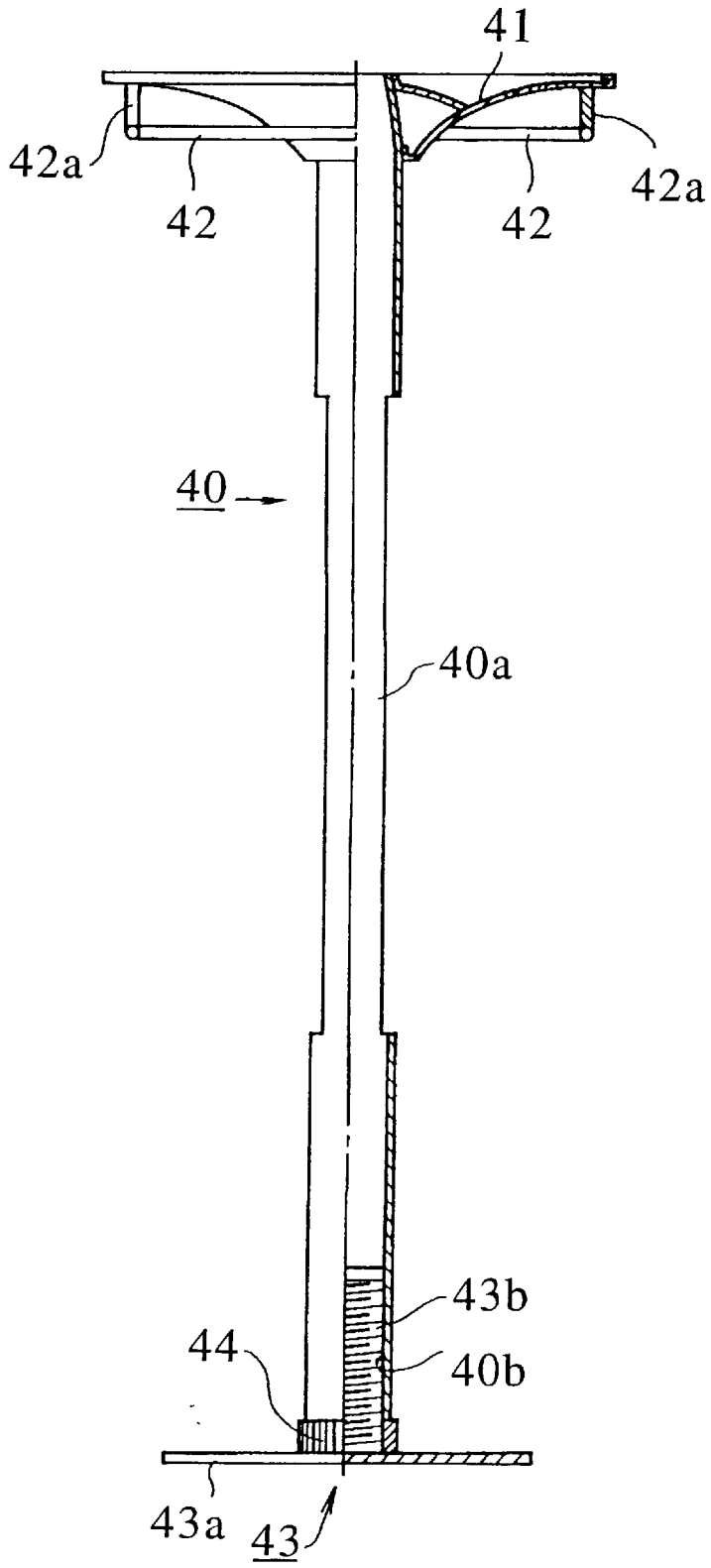
FIG. 16 is a partial sectional view showing the anti-earthquake holding rod shown in FIG. 15.
Figure 17:
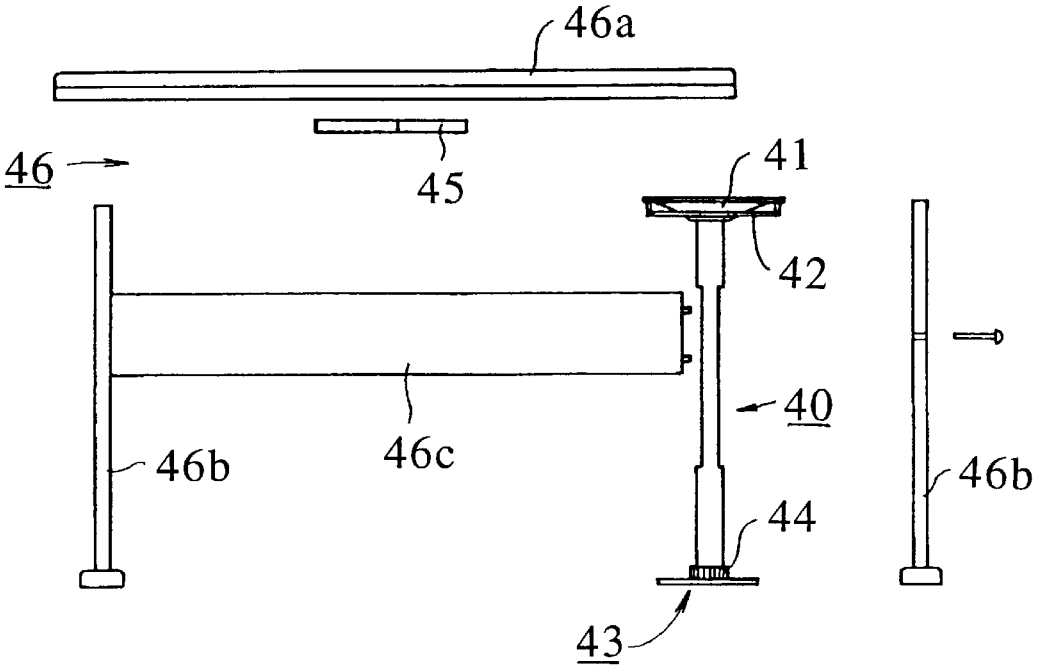
FIG. 17 is an illustrative view illustrating a method for fixing the anti-earthquake holding rod shown in FIG. 15 to a table.

FIGS. 15 to 18 illustrate a still further preferred embodiment of the present invention, wherein in FIGS. 15 to 17, reference numeral 40 denotes a round pipe-shape support made of high strength material such as metallic material of steel, stainless steel and aluminum, and a synthetic resin. It is apparent that the support is not necessarily constructed with the round pipe, and its section in its top plan may be of ellipse, rectangular and other polygonal shapes other than round and it is not limited to that shown in the preferred embodiment. To the substantial central axial part of the support 40 is passed through and arranged a longitudinal insertion hole 40*a*. To the upper part of the support 40 is arranged a flange-shape fixing member 41 having a plurality of fixing holes 41*a* by fixing, melt adhering, integral molding and the like. Although the fixing member 41 shown in the preferred embodiment is of a disk-like shape, it may be formed of various shapes such as ellipse, triangle, rectangle and other polygonal shapes and it is not limited to that shown in the preferred embodiment. To the lower part of the fixing member 41 is fixed ring-like hanger means 42 through fixing pins 42*a*, on which some taking-out goods such as flashlights, medicines, emergency rations and water (not shown) brought out in the case of emergency are hung. It may also be applicable that the hanger means 42 is fixed to the support 40 with pins, hooks or other means.

To the lower part of the support 40 is fixed an adjusting supporting member 43 comprised of a flange part 43*a* and a threaded rod 43*b* vertically arranged from the central part of the flange part 43*a* in such a manner that its height can be adjusted in the vertical direction by threadedly engaging the threaded rod 43*b* to a female threaded part 40*a* arranged in the support 40. Reference numeral 44 denotes a fixing nut for fixing the adjusting supporting member 43 to the support 40.

Figure 18:
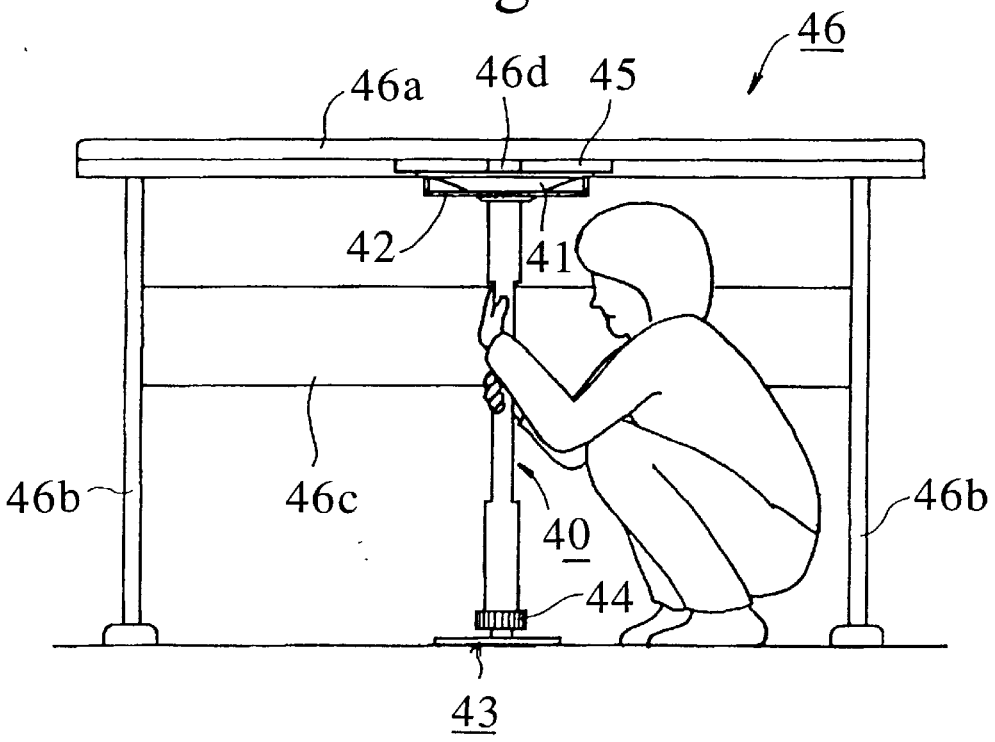
FIG. 18 is a front elevational view showing the table to which the anti-earthquake holding rod shown in FIG. 15 is installed.

Accordingly, in the case that the support 40 is fixed to an existing table or desk 46 having a beam member 46*c* as shown in FIGS. 17 and 18, legs 46*b*, 46*b* are removed from a top plate 46*a* of the table or desk 46, the beam member 46*c* is passed through the insertion hole 40*a* of the support 40, and thereafter as required, a fixing disk 45 is fixed to the lower surface of the substantial central part of the top plate 46*a* by means of adhesion and the like. Then, after the legs 46*b*, 46*b* are fixed to the top plate 46*a* and the beam member 46*c* is fixed between the legs 46*b*, 46*b*, the fixing member 41 is fixed to the fixing disk 45 or the top plate 46*a* by fixing screws or bolts (not shown) so as to cause the support 40 to be suspended down. After the adjusting supporting member 43 is rotated in the clockwise or counterclockwise direction to adjust the rod height and to cause it to be contacted with the ground, the fixing nut 44 is fastened and then fixed, completing the fixing of the holding rod to the table or desk 46. In addition, actually, it is sometimes found frequently that it is satisfactory to remove only one of the legs 46*b*, 46*b*. As shown in FIG. 18, when an earthquake occurs, a person escapes under the table or desk 46 and holds the support 40, eliminating any possibility that the table or desk 46 moves in an non-expected direction or the physical body of the person is thrown out of the tables or desk 46. In addition, in the case that another piece of furniture, a ceiling, a beam and the like fall on the table, it is possible to prevent the top plate 46*a* from being broken as much as possible due to the fact that the support 40 is present at the central part of the top plate 46*a* which is weak against a pressing force. As to the location where the support 40 is fixed, the central part of the top plate 46*a* becomes the most desirable place in view of the facts that even if a relative position between the table or desk and a person escaped thereunder is displaced due to the vibration of an earthquake, the top plate 46*a* can cover the person and additionally the central part is the most weak-strength location in the top plate 46*a*. It is optional, however, that the location is slightly displaced from the central part.

Figure 19:
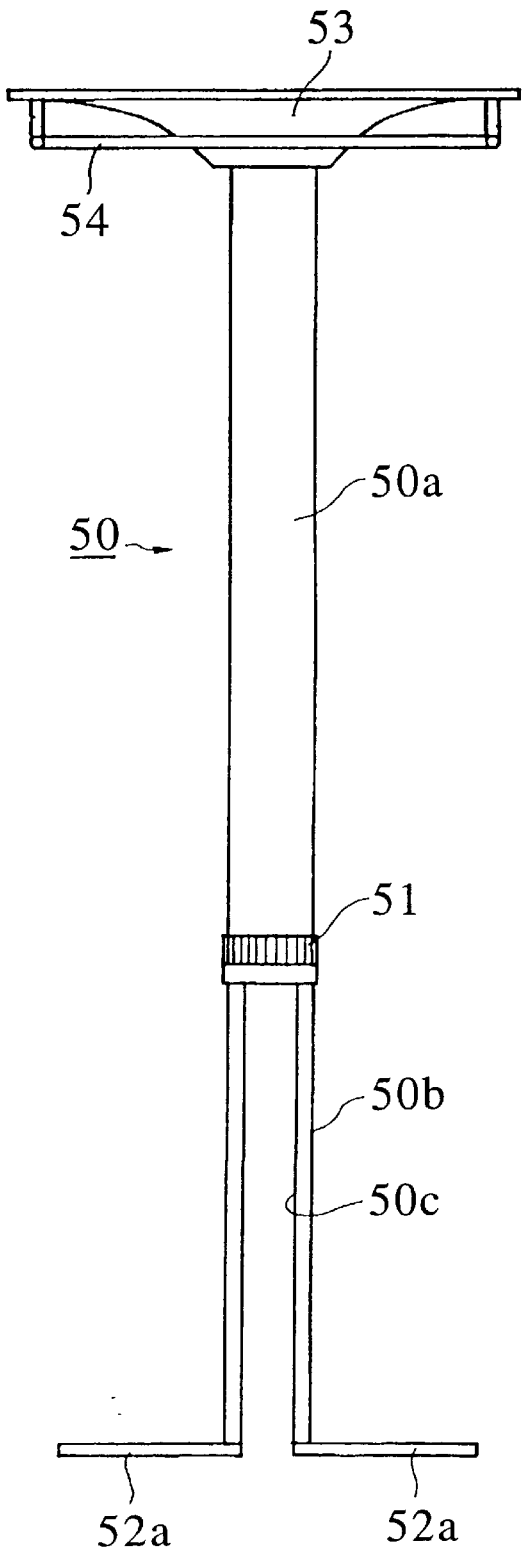
FIG. 19 is a front elevational view showing a still another preferred embodiment of the anti-earthquake holding rod of the present invention.
Figure 20:
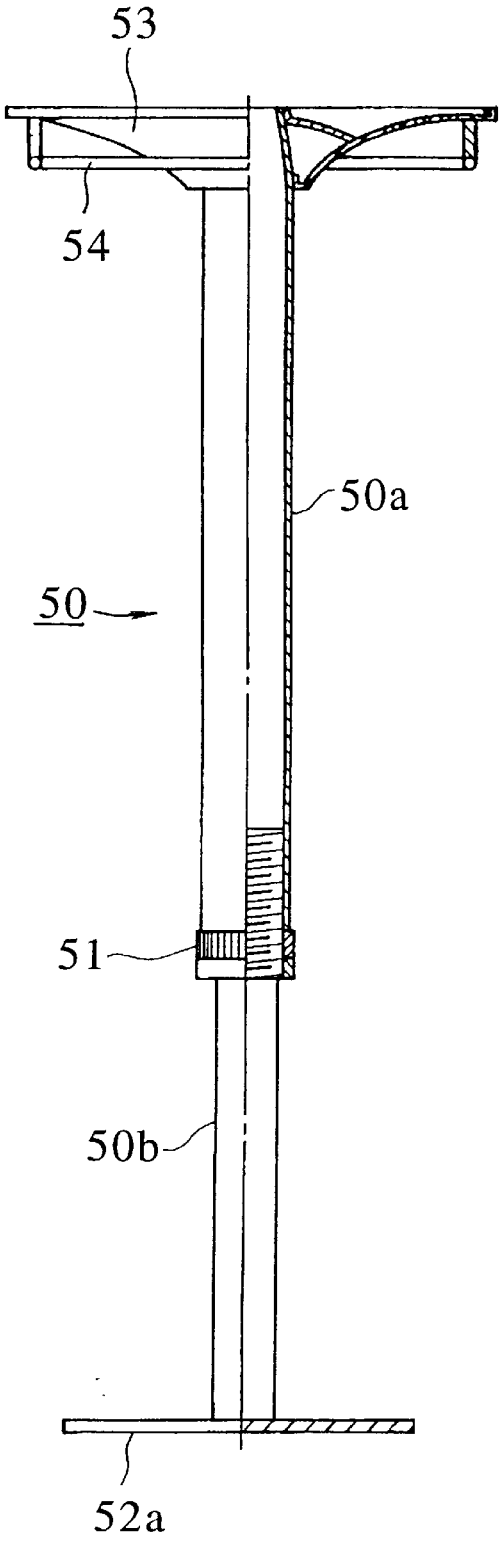
FIG. 20 is a side elevational view in section showing the anti-earthquake holding rod shown in FIG. 19.
Figure 21:
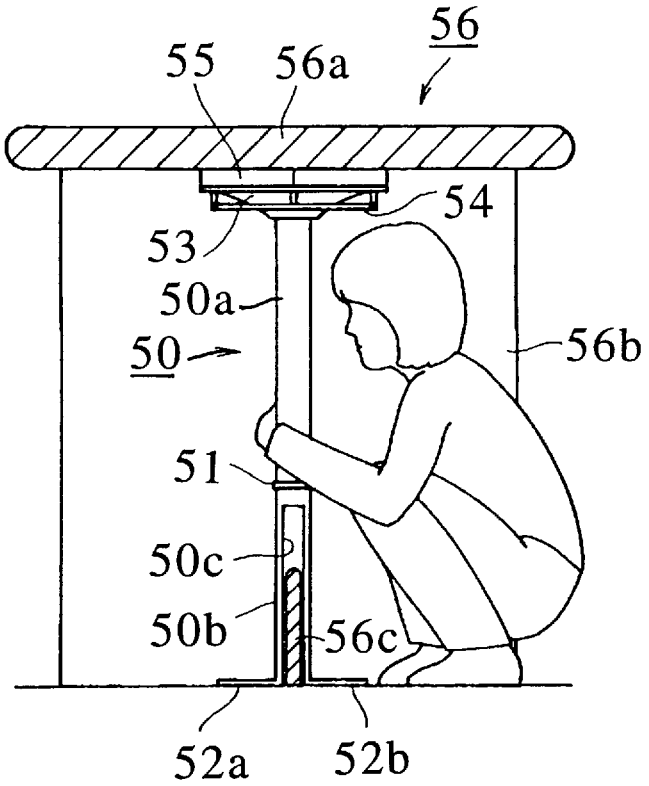
FIG. 21 is a side sectional view showing a table to which the anti-earthquake holding rod shown in FIG. 19 is fixed.

FIGS. 19 to 21 illustrate a still further preferred embodiment of the present invention, wherein in FIGS. 19 to 20, reference numeral 50 denotes a support made of the same material as that of the previous preferred embodiments. This support 50 is separated at its substantial central part into an upper support 50*a* and a lower support 50*b*. The extremity end of the lower support 50*b* is connected to the lower part of the upper support 50*a*, thereby the column can be extended or retracted in the axial direction. To the lower support 50*b* is fixed a fixing nut 51 for use in adjusting the entire height of the support 50 and concurrently an insertion groove 50*c* by dividing the lower support 50*b*. Reference numerals 52*a*, 52*a* denote stability plates.

Accordingly, as shown in FIG. 21, in the case that the holding rod is fixed to an existing table or desk 56 having a beam member 56*c* arranged at the central part of the lower end between the legs 56*b*, 56*b*, the beam member 56*c* is held inserted into the insertion groove 50*c*, thereafter a fixing member 53 is fixed to the lower surface of a top plate 56*a* of the table or desk 56 with fixing screws or bolts (not shown) through if necessary a fixing disk 55. Then the rod height is adjusted by the fixing nut 51 and the fixing of the rod to the existing table or desk 56 is completed. It would be satisfactory that this fixing nut 51 is of a double nut system in order to prevent its slacking state.

What is claimed is:

1. An anti-earthquake holding rod for use with a top plate of a table or desk, comprising:

a pipe-shaped support made of a metallic material;

a flange-shaped fixing member adapted to be fixed to a lower part of the top plate of the table or desk, said flange-shaped fixing member being fixed to an upper part of said pipe-shaped support;

an adjusting supporting member for adjusting a length of said pipe-shaped support, said adjusting supporting member being provided movably in an axial direction to a lower part of said pipe-shaped support; and a reinforcing fixing disk adapted to be between said flange-shaped fixing member and a lower surface of the top plate of the table or desk;

said reinforcing fixing disk having on one side thereof an adhesive agent layer with a protection sheet adhered thereon and said flange-shaped fixing member being adapted to be fixed at the lower part of the top plate by said reinforcing fixing disk adhered to the lower surface of the top plate.

2. An anti-earthquake holding rod comprising:

a pipe-shaped support made of a metallic material;

a flange-shaped fixing member adapted for fixing to a lower part of a top plate of a table or desk, said flange-shaped fixing member fixed to an upper part of said pipe-shaped support;

an adjusting supporting member for adjusting a length of said pipe-shaped support, said adjusting supporting member being provided movably in an axial direction to a lower part of said pipe-shaped support; and a reinforcing fixing disk for being between said flange-shaped fixing member and a lower surface of the top plate of said table or desk;

said fixing disk being divided into two segments and having an adhesive agent layer adhered to a protection sheet on one side surface of said layer and said flange-shaped fixing member being fixed at the lower part of the top plate by said fixing disk adhered to the lower surface of the top plate.

3. An anti-earthquake holding rod for use with a table and legs, the rod comprising:

a pipe-shaped support made of a metallic material;

a flange-shaped fixing member for fixing to a lower part of a top plate of a table or desk having legs, said flange-shaped fixing member fixed to an upper part of said pipe-shaped support;

an adjusting supporting member for adjusting a length of said pipe-shaped support, said adjusting supporting member being provided movably in an axial direction to a lower part of said pipe-shaped support;

said pipe-shaped support being provided with a longitudinal insertion hole in a radial direction of an intermediate portion of said pipe-shaped support, said longitudinal insertion hole having a beam member inserted therein and arranged between the legs of the table or desk.

4. An anti-earthquake holding rod comprising:

a pipe-shaped support made of a metallic material;

a flange-shaped fixing member for fixing to a lower part of a top plate of a table or desk with legs, said flange-shaped fixing member fixed to an upper part of said pipe-shaped support;

an adjusting supporting member for adjusting a length of said pipe-shaped support, said adjusting supporting member being provided movably in an axial direction to a lower part of said pipe-shaped support;

said pipe-shaped support being provided with a longitudinal insertion groove in a radial direction of a lower portion of said pipe-shaped support, said longitudinal insertion groove having a beam member inserted therein and arranged between legs of said table or desk.

5. An anti-earthquake holding rod according to claim 2 or 4, wherein a reinforcing fixing disk is included for fixing said fixing member to the lower part of the top plate of the table or desk.

6. An anti-earthquake holding rod according to any one of claims 1 or 2 or 3 or 4 wherein said support or said fixing member is provided with hanger means for hanging goods to be taken out in an emergency.

7. Anti-earthquake furniture such as a table or desk comprising:

a top plate;

legs fixed to a lower part of said top plate;

an anti-earthquake holding rod fixed to a central lower portion of said top plate;

said anti-earthquake holding rod comprising;

a pipe-shaped support made of a metallic material;

a flange-shaped fixing member for fixing to a lower part of the top plate said flange-shaped support;

an adjusting supporting member for adjusting a length of said pipe-shaped support, said adjusting supporting member being provided movably in an axial direction to a lower part of said pipe-shaped support.

8. Anti-earthquake furniture such as a table or desk:

provided with the anti-earthquake holding rod described in any one of claims 1 or 2 or 3 or 4, being fixed to the lower part of a top plate of said table or desk.

9. Anti-earthquake furniture such as a table or desk, provided with the anti-earthquake holding rod described in any one of claims 1 or 2 or 3 or 4, being suspended from the lower part of a top plate or said table or desk so as not to contact with the ground.

* * * * *